US009126406B1

(12) United States Patent
Furukawa

(10) Patent No.: US 9,126,406 B1
(45) Date of Patent: Sep. 8, 2015

(54) LIQUID DISCHARGE HEAD AND LIQUID DISCHARGE DEVICE

(71) Applicant: Seiko Epson Corporation, Tokyo (JP)

(72) Inventor: Ryota Furukawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/618,370

(22) Filed: Feb. 10, 2015

(30) Foreign Application Priority Data

Feb. 18, 2014 (JP) ..... 2014-028630

(51) Int. Cl.
*B41J 2/14* (2006.01)
*B41J 2/055* (2006.01)

(52) U.S. Cl.
CPC .. *B41J 2/14* (2013.01); *B41J 2/055* (2013.01); *B41J 2/14233* (2013.01); *B41J 2002/14491* (2013.01)

(58) Field of Classification Search
CPC ..... B41J 2/14233; B41J 2/055; B41J 2002/14241; B41J 2002/14491; B41J 2/14274; B41J 2/14314
USPC ..... 347/44, 45, 50, 57–59
See application file for complete search history.

(56) References Cited

U.S. PATENT DOCUMENTS 6,190,006 B1 * 2/2001 Kurashima et al. ..... 347/70
6,794,746 B2 * 9/2004 Sato ..... 257/700
8,573,746 B2 * 11/2013 Miyata ..... 347/50

FOREIGN PATENT DOCUMENTS

JP 2012-081644 4/2012
JP 2012-199314 10/2012

* cited by examiner

*Primary Examiner* — An Do

(57) ABSTRACT

A liquid discharge head of the invention includes a drive substrate, a flexible wiring substrate mounted in a standing state with respect to the drive substrate, and a semiconductor device which is mounted on the flexible wiring substrate and which has a pair of long sides in a direction crossing a direction in which the flexible wiring substrate stands. A plurality of output electrodes respectively electrically connected to the electrodes of the drive substrate are arranged on and along the long side of the semiconductor device facing the drive substrate. A plurality of input electrodes are arranged on and along the long side opposite to the long side of the semiconductor device facing the drive substrate. A circuit that drives the drive element is provided in a region between two certain input electrodes of the semiconductor device.

3 Claims, 8 Drawing Sheets

(FIRST REFERENCE EXAMPLE)

(SECOND REFERENCE EXAMPLE)

LIQUID DISCHARGE HEAD AND LIQUID DISCHARGE DEVICE

BACKGROUND

1. Technical Field

The present invention relates to a liquid discharge head and a liquid discharge device.

2. Related Art

A COF (Chip on Film) packaging technology is known in which a semiconductor device (semiconductor chip IC) is mounted on a flexible printed circuit (FPC) by collectively electrically connecting bumps formed on electrode pads of the semiconductor device to a wiring pattern of the FPC. In the COF packaging technology, a technique is known in which, when a bonding pitch for the packaging is large, an anisotropic conductive film (ACF) is sandwiched between an FCP and a semiconductor device and they are heated and pressure-bonded together, so that particles pressed between a bump and a wiring pattern become conductive and the particles electrically connect the bump and the wiring pattern. Further, when the bonding pitch is small, metal eutectic bonding by heat pressure bonding represented by bonding of tin and gold and a metal bonding technique using ultrasonic wave represented by bonding of gold to gold are known. The COF packaging technology is widely used in various precision devices such as a printing device, a mobile phone, and a liquid crystal display device.

In a head that discharges ink, a drive element is provided for each nozzle. In a semiconductor device that controls the head, an output electrode that outputs a signal to each drive element is provided corresponding to each nozzle. Therefore, the greater the number of nozzles, the greater the number of output electrodes of the semiconductor device that controls the head, so that the shape of the semiconductor device becomes elongated (see JP-A-2012-199314 and JP-A-2012-81644).

SUMMARY

In a head described in JP-A-2012-81644, a flexible wiring substrate mounted with a semiconductor device is mounted in a standing state with respect to a substrate including piezoelectric elements and electrodes. When the head is configured as described above, if the size of the semiconductor device in a direction in which the flexible wiring substrate stands can be reduced, the size of the flexible wiring substrate in a direction in which it stands can be reduced, so that the height of the head can be reduced.

An advantage of some aspects of the invention is that the size of the semiconductor device in the height direction (thickness direction) is reduced and the height of the head is reduced.

A main invention to achieve the above advantage is a liquid discharge head including a drive substrate including a plurality of drive elements and a plurality of electrodes respectively connected to the plurality of drive elements, a flexible wiring substrate mounted in a standing state with respect to the drive substrate, and a semiconductor device which is mounted on the flexible wiring substrate and which has a pair of long sides in a direction crossing a direction in which the flexible wiring substrate stands. Further, in the liquid discharge head, a plurality of output electrodes respectively electrically connected to the electrodes of the drive substrate are arranged on and along the long side of the semiconductor device facing the drive substrate, a plurality of input electrodes are arranged on and along the long side opposite to the long side of the semiconductor device facing the drive substrate, and a circuit that drives the drive element is provided in a region between two certain input electrodes of the semiconductor device.

The other features of the invention will become apparent from the description of the present specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
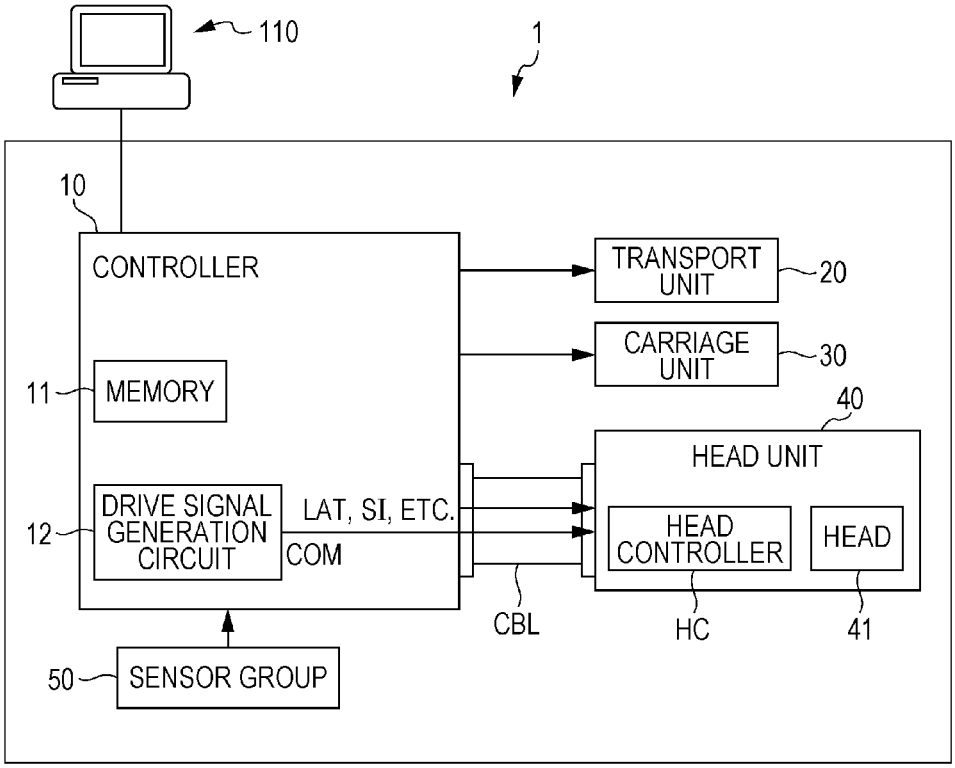
FIG. 1 is a block diagram of a configuration of a printer.

At least the following matters will become apparent from the description of the present specification and the accompanying drawings.

A liquid discharge head will become apparent which includes a flow passage forming substrate including a plurality of piezoelectric elements and a plurality of electrodes respectively connected to the plurality of piezoelectric elements, a flexible printed circuit mounted in a standing state with respect to the flow passage forming substrate, and a head controller which is mounted on the flexible printed circuit and which has a pair of long sides in a direction crossing a direction in which the flexible printed circuit stands, and in which a plurality of output electrodes (output electrode pads or bumps provided to be electrically connected to the output electrode pads) respectively electrically connected to the electrodes of the flow passage forming substrate are arranged on and along the long side of the head controller facing the flow passage forming substrate, a plurality of input electrodes (input electrode pads or bumps provided to be electrically connected to the input electrode pads) are arranged on and along the long side opposite to the long side of the head controller facing the flow passage forming substrate, and a circuit that drives the piezoelectric element is provided in a region between two certain input electrodes of the head controller. According to the liquid discharge head, it is possible to reduce the size of the head controller in the short side direction, so that it is possible to reduce the height of the head.

It is desirable that all the output electrodes of the head controller which are electrically connected to the electrodes of the flow passage forming substrate are arranged on the long side facing the flow passage forming substrate. Thereby, the intervals of the input electrodes increase, so that it becomes easy to arrange a circuit between two input electrodes.

A liquid discharge device will become apparent which includes a flow passage forming substrate including a plurality of piezoelectric elements and a plurality of electrodes respectively connected to the plurality of piezoelectric elements, a flexible printed circuit mounted in a standing state with respect to the flow passage forming substrate, and a head controller which is mounted on the flexible printed circuit and which has a pair of long sides in a direction crossing a direction in which the flexible printed circuit stands, and in which a plurality of output electrodes respectively electrically connected to the electrodes of the flow passage forming substrate are arranged on and along the long side of the head controller facing the flow passage forming substrate, a plurality of input electrodes are arranged on and along the long side opposite to the long side of the head controller facing the flow passage forming substrate, and a circuit that drives the piezoelectric element is provided in a region between two certain input electrodes of the head controller. According to the liquid discharge head, it is possible to reduce the height of the head, so that it is possible to reduce the size of the liquid discharge device.

First Embodiment

Configuration of Printer

Figure 2:
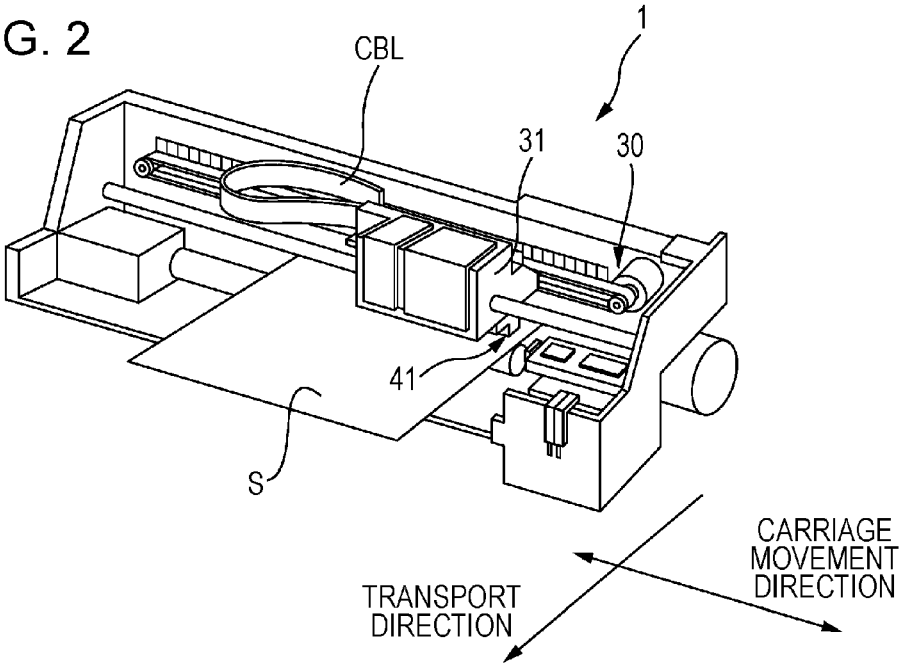
FIG. 2 is a perspective view of the printer.

First, a printer that uses a semiconductor device (a head controller HC described later) of the present embodiment will be described. FIG. 1 is a block diagram of a configuration of a printer 1. FIG. 2 is a perspective view of the printer 1.

The printer 1 includes a controller 10, a transport unit 20, a carriage unit 30, a head unit 40, and a sensor group 50. The printer 1 which receives print data from a computer 110 controls each unit by the controller 10.

The controller 10 is a control device for controlling the printer 1. The controller 10 controls each unit according to a program stored in the memory 11. Further, the controller 10 controls each unit based on the print data received from the computer 110 and prints an image on a medium S. Various detection signals detected by the sensor group 50 are inputted into the controller 10. The controller 10 includes a drive signal generation circuit 12. The drive signal generation circuit 12 includes a drive signal generation circuit 12 that generates a drive signal COM for driving a piezoelectric element (described later). The drive signal COM of the drive signal generation circuit 12 and the drive of the piezoelectric element (drive element) will be described later.

The transport unit 20 is a mechanism for transporting a medium S (for example, paper and film) in a transport direction. The transport direction is a direction crossing a movement direction of a carriage 31.

The carriage unit 30 is a mechanism for moving the carriage 31 in the movement direction. The carriage can reciprocate along the movement direction. The carriage 31 is provided with a head 41 of the head unit 40.

The head unit 40 is a unit for discharging ink to the medium S. The head unit 40 includes the head 41 and the head controller HC (semiconductor device) for controlling the head 41. Various signals necessary to control the head 41 are transmitted to the head unit 40 from the controller 10 through a cable CBL.

Figure 3:
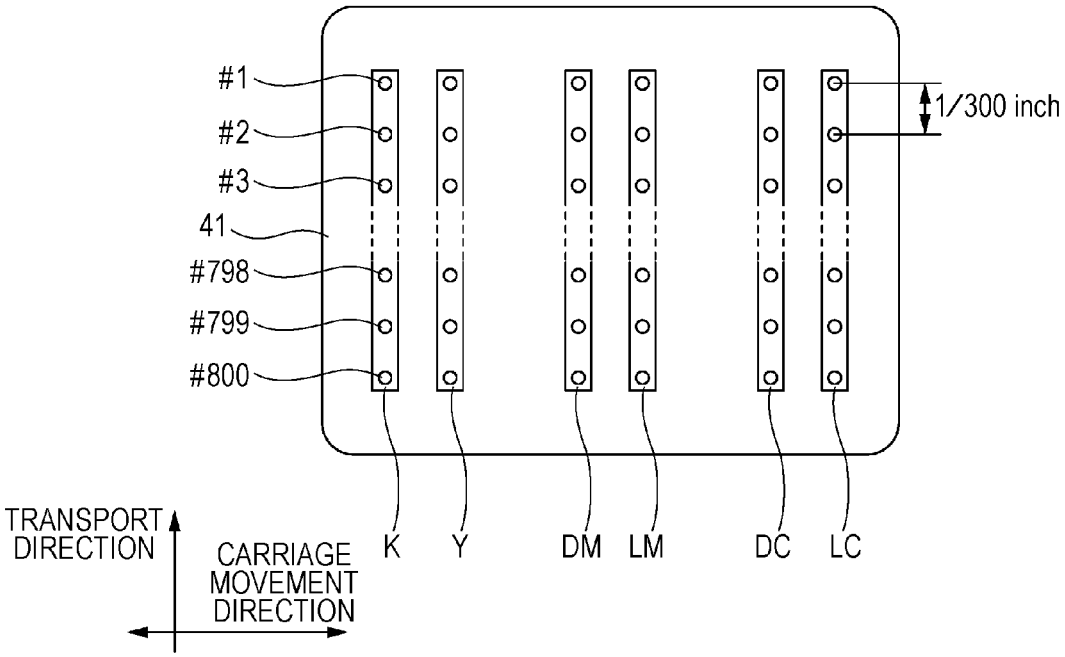
FIG. 3 is a diagram of a head as seen from the below.

FIG. 3 is a diagram of the head 41 as seen from the below. The head 41 includes nozzle arrays of six colors (black K, yellow Y, dark magenta DM, light magenta LM, dark cyan DC, and light cyan LC). The six nozzle arrays are aligned along the movement direction of the carriage 31. Each nozzle array includes 800 nozzles that are discharge orifices for discharging ink. The 800 nozzles are aligned along the transport direction at intervals of 1/300 inch (300 dpi).

Figure 4:
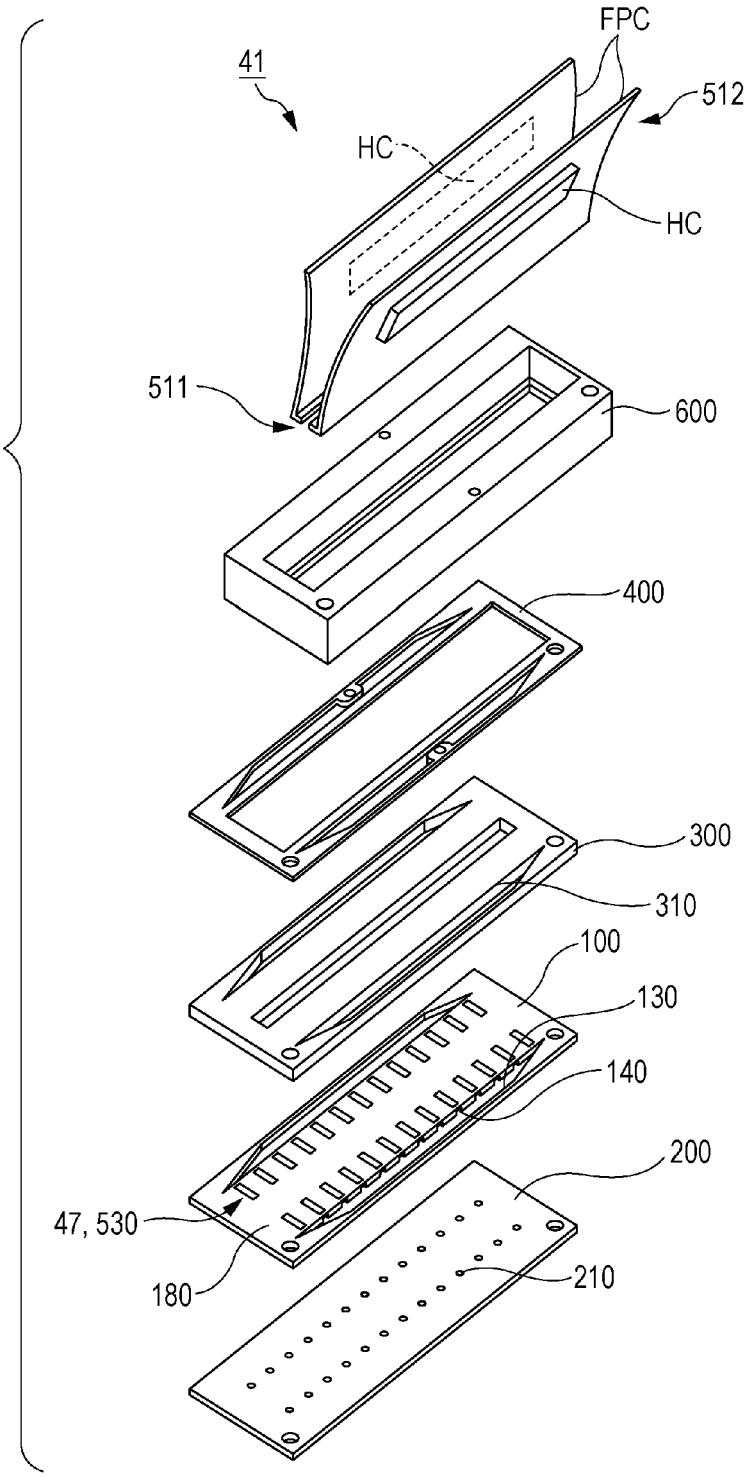
FIG. 4 is an exploded perspective view of the head.
Figure 5:
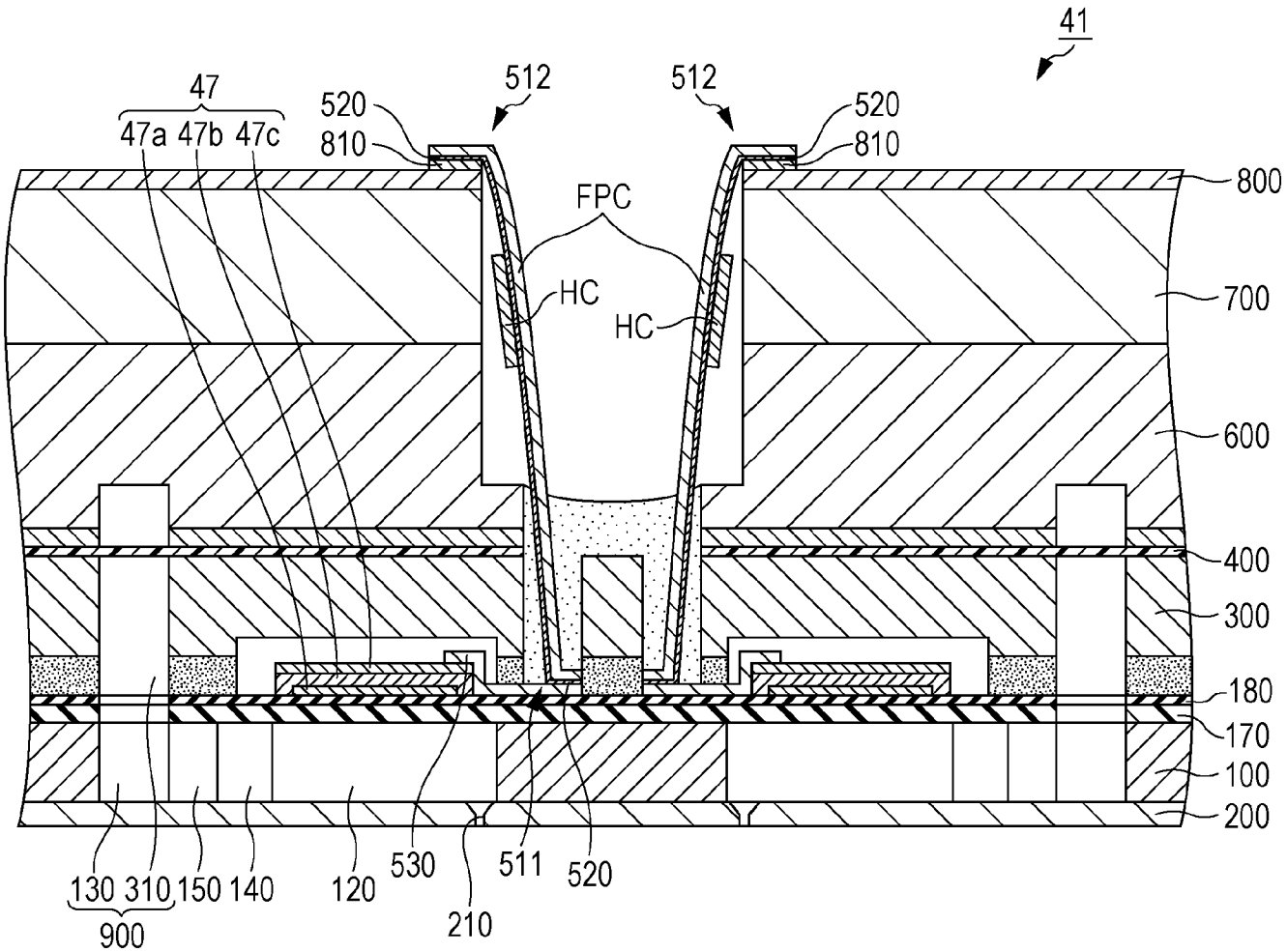
FIG. 5 is a schematic cross-sectional view for explaining an internal configuration of the head.

FIG. 4 is an exploded perspective view of the head 41. FIG. 5 is a schematic cross-sectional view for explaining an internal configuration of the head 41. The head 41 includes the flexible printed circuit FPC and the head controller HC that is a semiconductor device (semiconductor chip IC). A wiring pattern of the flexible printed circuit FPC will be described later.

The head 41 includes a flow passage forming substrate 100, a nozzle plate 200, a protective substrate 300, and a compliance substrate 400. The flow passage forming substrate 100, the nozzle plate 200, and the protective substrate 300 are stacked so that the nozzle plate 200 and the protective substrate 300 sandwich the low passage forming substrate 100. The compliance substrate 400 is provided on the protective substrate 300. Further, a case head 600, which is a protective member, is provided on the compliance substrate 400. A holder member 700 and a relay substrate 800 are provided on the case head 600.

In the flow passage forming substrate 100, two rows of a plurality of pressure generation chambers 120 partitioned by a partition wall are provided as rows juxtaposed in the width direction of the pressure generation chambers 120. Here, the pressure generation chambers 120 are provided as pairs. A communication portion 130 is formed in a longitudinal outside region of the pressure generation chambers 120 in each row, and the communication portion 130 and each pressure generation chamber 120 are communicated with each other through an ink supply passage 140 and a communication passage 150 provided for each pressure generation chamber 120. The communication portion 130 communicates with a reservoir portion 310 in the protective substrate 300 and forms a part of a manifold 900, which is a common ink chamber for each row of the pressure generation chambers 120. The ink supply passage 140 is formed to have a width smaller than that of the pressure generation chamber 120, and the ink supply passage 140 maintains a passage resistance of ink flowing into the pressure generation chamber 120 from the communication portion 130 at a constant value. On the other hand, an elastic film 170 is formed on the side opposite to an opening surface of the flow passage forming substrate 100, and an insulator film 180 is formed on the elastic film 170. Further, a lower electrode 47*a* formed of a metal such as platinum (Pt) or a metal oxide such as strontium ruthenium oxide (SrRuO), a piezoelectric layer 47*b* having a perovskite structure, and an upper electrode 47*c* formed of a metal such as Au and Ir are formed on the insulator film 180 to form a piezoelectric element 47. Here, the piezoelectric element 47 is a portion including the lower electrode 47*a*, the piezoelectric layer 47*b*, and the upper electrode 47*c*. The piezoelectric element 47 forms a pair with the pressure generation chamber 120.

The flexible printed circuit FPC includes a first end portion 511 and a second end portion 512 located opposite to the first end portion 511. The first end portion 511 of the flexible printed circuit FPC is inserted into the protective substrate 300 and the second end portion 512 is connected to the relay substrate 800. The first end portion 511 is arranged to face an opposed piezoelectric element 47. The flexible printed circuit FPC is a flexible substrate and the first end portion 511 is bent into a substantially L shape so that the interior angle θ is an obtuse angle. It is desirable that the interior angle θ of the substantially L shape is 95° or more and less than 110°. A wiring 520 of the first end portion 511 of the flexible printed circuit FPC is connected to the upper electrode 47*c* of the piezoelectric element 47 through a lead electrode 530. The flow passage forming substrate 100 (100, 170, and 180) including a plurality of piezoelectric elements 47 and a plurality of lead electrodes 530 electrically connected to each piezoelectric element may be referred to as a "drive substrate". The wiring 520 of the first end portion 511 and the lead electrode 530 of the drive substrate are bonded together by using an ACF (Anisotropic Conductive Film) adhesive, which is not shown in the drawings, and applying pressure. The second end portion 512 of the flexible printed circuit FPC is inserted into a slit of the holder member 700 and a slit of the relay substrate 800. A wiring 520 of the second end portion 512 is bonded to a terminal 810 of the relay substrate 800. Thereby, as shown in FIGS. 4 and 5, the flexible printed circuit FPC is mounted in a standing state with respect to the drive substrate. In other words, the flexible printed circuit FPC is arranged in a substantially vertical direction with respect a nozzle surface (see FIG. 3). Further, the flexible printed circuit FPC is mounted with the head controller HC and each piezoelectric element 47 is driven by the head controller HC (this will be described later). The head controller HC is mounted on the printed circuit FPC so that the long side of the head controller HC is along a direction perpendicular to a direction in which the flexible printed circuit FPC stands (a direction in parallel with the nozzle surface). Therefore, as described later, if the size of the head controller HC in the short side direction (the height direction) can be reduced, the size of the flexible printed circuit FPC in the direction in which it stands can be reduced, so that the height of the head 41 can be reduced.

The case head 600 is provided with an ink introduction passage (not shown in the drawings) that supplies ink from an ink reservoir means such as an ink cartridge to the manifold 900. In the head 41 as described above, the ink is taken from the ink cartridge and the inside of the head 41 from the manifold 900 to a nozzle opening 210 is filled with the ink, and thereafter, a voltage is applied between the lower electrode 47*a* and the upper electrode 47*c* corresponding to the pressure generation chamber 120 according to a signal from the head controller HC. When the voltage is applied, the elastic film 170 and the piezoelectric layer 47*b* are deflected and deformed and the pressure in each pressure generation chamber 120 increases, so that an ink drop is discharged from the nozzle opening 210.

Figure 6:
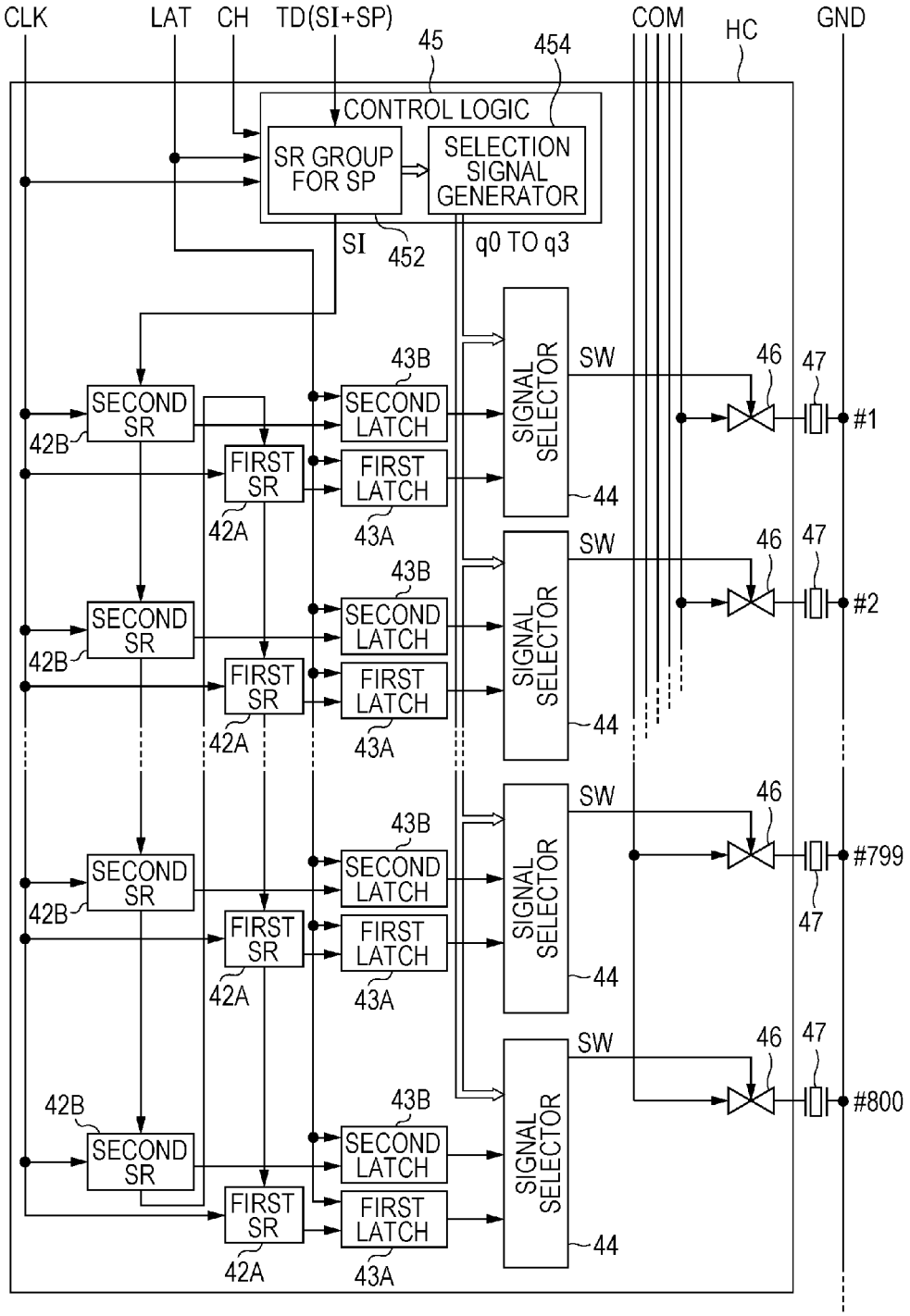
FIG. 6 is an illustration of a head controller HC.

FIG. 6 is an illustration of the head controller HC. The head controller HC controls an application of a drive signal COM to the piezoelectric element 47 provided for each nozzle of the head 41. The head controller HC includes shift registers 42 (a first shift register 42A and a second shift register 42B), latch circuits 43 (a first latch circuit 43A and a second latch circuit 43B), a signal selector 44, a control logic 45, and a switch 46. The components other than the control logic 45 in the head controller HC are provided for each piezoelectric element 47 (in other words, for each nozzle). The control logic 45 includes a shift register group 452 that stores setting data SP and a selection signal generator 454 that generates selection signals q0 to q3 according to the setting data SP.

A clock signal CLK, a latch signal LAT, a change signal CH, and a setting signal TD including pixel data SI and setting data SP are inputted into the head controller HC from the controller 10 through the cable CBL. Further, the drive signal COM is inputted into the head controller HC from the drive signal generation circuit 12 of the controller 10 through the cable CBL.

Figure 7:
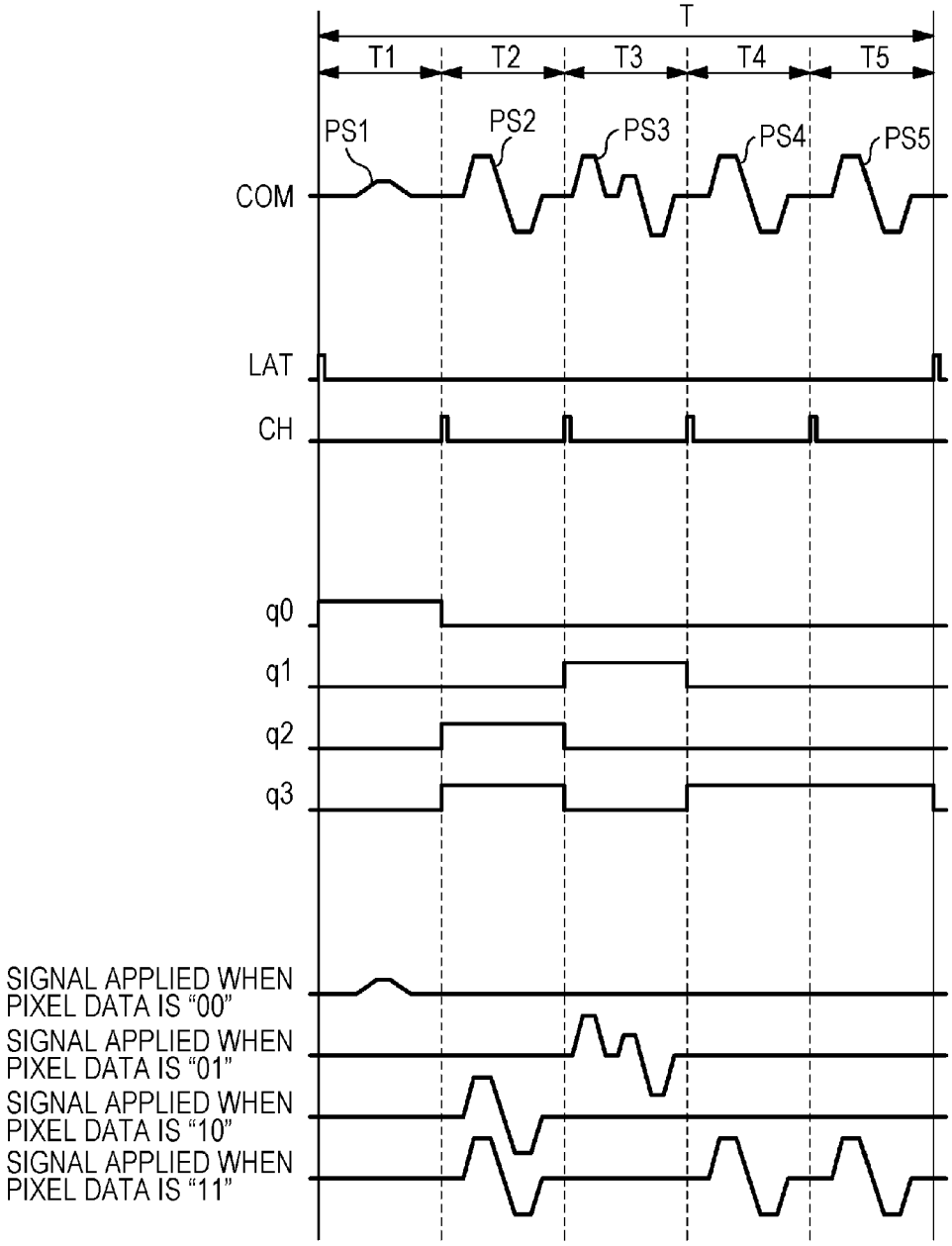
FIG. 7 is an illustration of various signals in the head controller HC.

FIG. 7 is an illustration of various signals in the head controller HC. The drive signal COM is repeatedly generated for each cycle period T. The cycle period T is a period required for the carriage 31 to move a distance corresponding to one pixel. In this way, each time the carriage 31 moves a predetermined distance, the drive signal COM having the same waveform is repeatedly generated from the drive signal generation circuit 12. The cycle period T can be divided into five sections T1 to T5. The drive signal COM is generated so that the first section T1 includes a drive pulse PS1, the second section T2 includes a drive pulse PS2, the third section T3 includes a drive pulse PS3, the fourth section T4 includes a drive pulse PS4, and the fifth section T5 includes a drive pulse PS5. The waveforms of the drive pulses PS1 to PS5 are defined based on an operation to be performed by the piezoelectric element 47.

The latch signal LAT is a signal that defines the cycle period T. A pulse signal of the latch signal LAT is outputted every time the carriage 31 moves a predetermined distance. The change signal CH is a signal for dividing the cycle period T into the five sections T1 to T5. The selection signals q0 to q3 are signals outputted from the selection signal generator 454. The selection signal generator 454 determines an L level or an H level in the five sections T1 to T5 of each of the selection signals q0 to q3 on the basis of the setting signal SP and outputs the selection signals q0 to q3. A waveform of an applied signal that is applied to the piezoelectric element 47 varies according to content of pixel data corresponding to each piezoelectric element 47. The pixel data is data indicating a dot size to be formed for each pixel. Here, the pixel data is 2-bit data.

Next, an operation until the applied signal is applied to the piezoelectric element 47 by the head controller HC will be described. When the setting data SP and the pixel data SI are inputted into the head controller HC in synchronization with the clock CLK, lower bit data of the pixel data, which is 2-bit data, is set in the first shift register 42A, higher bit data is set in the second shift register 42B, and the setting data SP is set in the shift register group 452 of the control logic 45. Then, according to the pulse of the latch signal LAT, the lower bit data is latched by the first latch circuit 43A, the higher bit data is latched by the second latch circuit 43B, and the setting data SP is latched by the selection signal generator 454.

The signal selector 44 selects one of the selection signals q0 to q3 according to the 2-bit pixel data latched by the first latch circuit 43A and the second latch circuit 43B. For example, when the pixel data is "00" (when the lower bit is "0" and the higher bit is "0"), the selection signal q0 is selected. The signal selector 44 outputs the selected selection signal to the switch 46 as a switch signal SW.

The drive signal COM and the switch signal SW are inputted into the switch 46. When the switch signal SW is H level, the switch 46 becomes ON state and the drive signal COM is applied to the piezoelectric element 47. When the switch signal SW is L level, the switch 46 becomes OFF state and the drive signal COM is not applied to the piezoelectric element 47.

For example, when the pixel data is "00", the switch 46 is turned ON/OFF by the selection signal q0, the drive pulse PS1 of the drive signal COM is applied to the piezoelectric element 47, and the piezoelectric element 47 is driven by the drive pulse PS1. As a result, a pressure variation, by which ink is not discharged, occurs in the ink in a chamber and an ink meniscus (free surface of the ink exposed at the nozzle) vibrates slightly. Similarly, when the pixel data is "01", the piezoelectric element 47 is driven by the drive pulse PS3, so that a small dot is formed on the medium S. When the pixel data is "10", the drive pulse PS2 of the drive signal COM is applied to the piezoelectric element 47 and an intermediate dot is formed on the medium S. When the pixel data is "11", the drive pulses PS2, PS4, and PS5 of the drive signal COM are applied to the piezoelectric element 47 and a large dot is formed on the medium S.

Head Controller HC

Figure 8A:
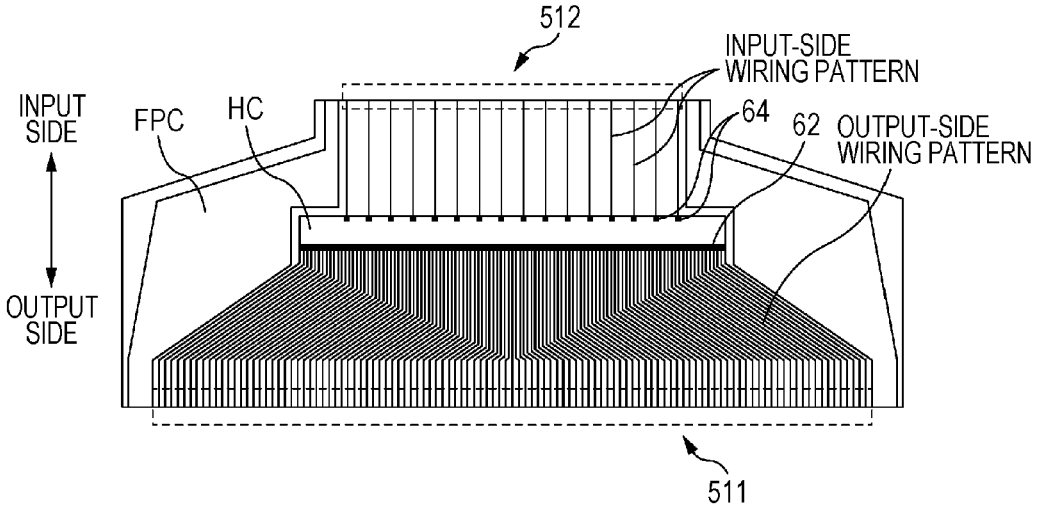
FIG. 8A is an illustration of a wiring pattern of a flexible printed circuit FPC of a first embodiment.
Figure 8B:
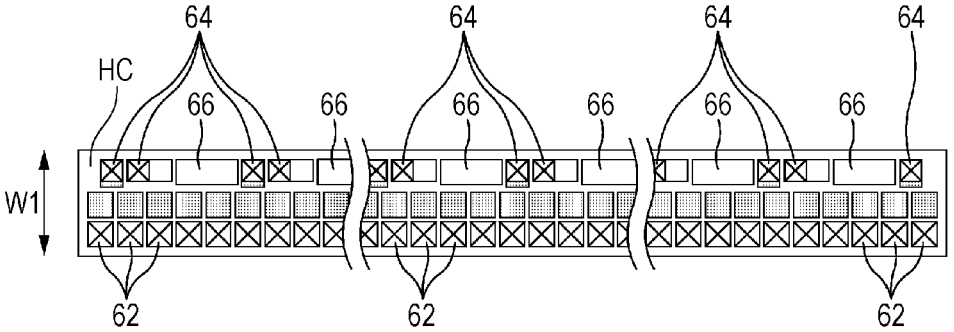
FIG. 8B is a schematic illustration of a layout of a head controller HC of the first embodiment.

FIG. 8A is an illustration of a wiring pattern of the flexible printed circuit FPC of the first embodiment. FIG. 8B is a schematic illustration of the inside of a layout of the head controller HC of the first embodiment. FIG. 8B shows the layout of the head controller HC as seen from a direction perpendicular to a mounting surface.

The flexible printed circuit FPC shown in FIG. 8A is a substrate mounted with the head controller HC that is a semiconductor device (semiconductor chip/IC). On the flexible printed circuit FPC, an input side wiring pattern for inputting input signals (for example, the clock signal CLK, the latch signal LAT, and the drive signal COM) into the head controller HC and an output side wiring pattern for supplying output signals for driving the piezoelectric elements (drive elements) 47 from the head controller HC are formed.

The head controller HC includes a plurality of output electrodes 62 and a plurality of input electrodes 64 (see FIG. 8B). The output electrodes 62 are electrodes that output signals to the 800 piezoelectric elements 47, respectively. The input electrodes 64 are electrodes for inputting, for example, the clock signal CLK, the latch signal LAT, and the drive signal COM. The head controller HC has 800 output electrodes 62 and the number of the input electrodes 64 is smaller than 800.

The head controller HC is provided with the output electrodes 62 that output signals to the 800 piezoelectric elements 47, so that the head controller HC has an elongated shape (rectangular shape). In FIGS. 8A and 8B, the head controller HC is arranged so that the longitudinal direction (long side direction) of the head controller HC crosses a direction in which the flexible printed circuit FPC stands with respect to the drive substrate. Of a pair of long sides of the head controller HC, on a long side on the side of the drive substrate (hereinafter referred to as an "output side") of the head controller HC, the output electrodes 62 are aligned, and on a long side on the opposite side (hereinafter referred to as an "input side"), the input electrodes 64 are aligned.

The number of the input electrodes 64 aligned on the long side of the input side of the head controller HC is smaller than that of the output electrodes 62 aligned on the long side of the output side. Therefore, the interval and the pitch of the input electrodes 64 are larger than the interval of the output electrodes 62. For example, while the interval of the output electrodes 62 is 30 μm, the interval of the input electrodes 64 is 400 μm.

In the present embodiment, by using the large interval of the input electrodes 64, the control logic circuit 66 is arranged in a region between the input electrodes 64 on the long side on which the input electrodes 64 are arranged. In other words, in the present embodiment, the control logic circuit 66 is arranged adjacent to the input electrode 64 in the long side direction of the head controller HC and is not arranged between the input electrode 64 and the output electrode 62. The control logic circuit 66 in FIG. 8B is a part of a circuit that drives the piezoelectric element 47. The control logic circuit 66 is a circuit different from circuits associated with each nozzle (for example, the shift registers 42 and the latch circuits 43) among the circuits included in the head controller HC. The control logic circuit 66 includes, for example, the control logic 45 shown in FIG. 6 and has a transistor region. When the head controller HC adjusts a voltage of the applied signal applied to the piezoelectric element 47, the control logic circuit 66 may include a temperature sensor. In the present embodiment, it is possible to reduce the size W1 in the short side direction of the head controller HC by arranging the control logic circuit 66 between the input electrodes 64.

Figure 8C:
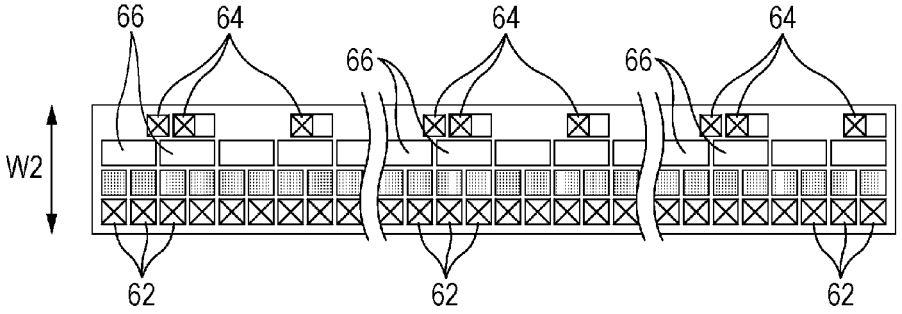
FIG. 8C is an illustration of a layout of a first reference example.

FIG. 8C is an illustration of a layout of a first reference example. In the first reference example, the control logic circuit 66 is arranged closer to the output side than the input electrode 64. In other words, in the first reference example, the control logic circuit 66 is arranged more inside of the head controller HC than the input electrode 64. In the first reference example, the control logic circuit 66 is not arranged in a region between the input electrodes 64 differently from the present embodiment (see FIG. 8B) and is arranged in a region between the input electrode 64 and the output electrode 62, so that the size W2 in the short side direction of the head controller HC is increased by the width of the control logic circuit 66. As a result, for example, while the size W1 of the head controller HC of the present embodiment is 3 mm, the size W2 of the reference example is about 4 mm.

In the present embodiment, it is possible to reduce the size W1 in the short side direction of the head controller HC as compared with the first reference example. As a result, it is possible to reduce the size from the end of the input side to the end of the output side of the flexible printed circuit FPC (the size in the vertical direction in FIG. 8A). The flexible printed circuit FPC is mounted in a standing state with respect to the drive substrate (see FIG. 4), so that if the size of the flexible printed circuit FPC in the direction in which it stands can be reduced, the height of the head 41 can be reduced.

Figure 9:
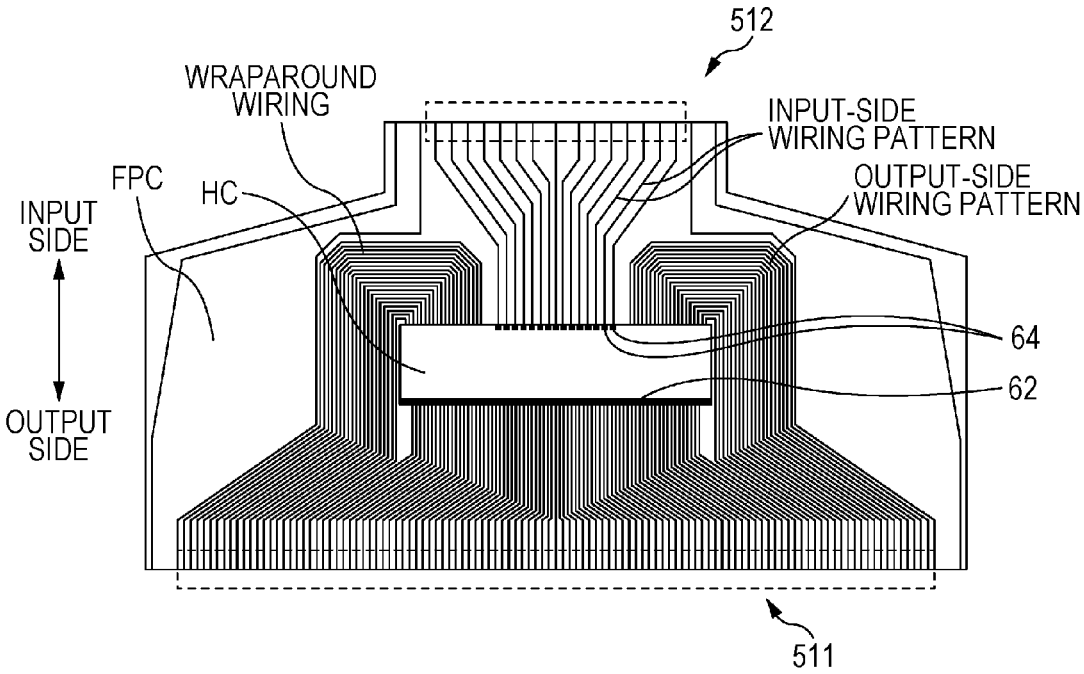
FIG. 9 is an illustration of a second reference example.

FIG. 9 is an illustration of a second reference example. In the second reference example, the output electrodes 62 are also arranged on the long side of the input side of the head controller HC. In the case of the second reference example, the intervals of the input electrodes 64 of the input side of the head controller HC are small, so that it is difficult to arrange the control logic circuit 66 between two input electrodes as in the present embodiment. Further, in the case of the second reference example, on the flexible printed circuit FPC, it is necessary to form an output wiring pattern (wraparound wiring in FIG. 9) so that the output wiring pattern is drawn from the output electrodes provided on the long side of the input side of the head controller HC to the input side, and thereafter, the output wiring pattern is caused to detour around the outside of the short side and reach the end portion of the output side. Therefore, in the case of the second reference example, even if the size of the head controller HC in the short side direction can be reduced, it is necessary to form the wraparound wiring on the flexible printed circuit FPC, so that it is difficult to reduce the size of the flexible printed circuit FPC and reduce the height of the head 41. In other words, the wiring of a portion drawn from the output electrodes 62 provided on the long side of the input side to the input side occupies a space for forming wiring in a direction in which the flexible printed circuit FPC stands, so that it prevents the size of the height in a state in which the flexible printed circuit FPC stands (the size of the thickness as a device) from being reduced. Further, routing of wiring that wraps around each of both ends of the short side of the head controller HC is performed, so that the size of the flexible printed circuit FPC in the long side direction is increased.

In the present embodiment, all the output electrodes 62 are arranged on the long side of the head controller HC facing the drive substrate to which the piezoelectric elements (drive elements) are connected (see FIGS. 8A and 8B), and no output electrode 62 is provided on the long side opposite to the long side described above. Therefore, in the present embodiment, it is possible to ensure large intervals of the input electrodes 64 as compared with the second reference example, so that it is easy to arrange the control logic circuit 66 between two input electrodes 64. Further, in the present embodiment, the wraparound wiring as described in the second reference example is not required, so that if the size W1 of the head controller HC in the short side direction can be reduced, the size of the flexible printed circuit FPC can be reduced and the heights of the head 41 and the liquid discharge device can be reduced.

OTHER EMBODIMENTS

The above embodiment is intended for easier understanding of the invention and does not limit the interpretation of the invention. Needless to say, the invention may be modified and improved without departing from the scope of the invention and the invention includes equivalents thereof.

About Printer 1

In the embodiment described above, the liquid discharge device is a serial type printer in which the head 41 moves. However, the liquid discharge device may be a line type printer in which a head is fixed. Further, the liquid discharge device is not limited to a printer that discharges ink. For example, the liquid discharge device may be a processing device which discharges processing liquid from nozzles.

About Piezoelectric Element 47

In the embodiment described above, the piezoelectric element 47 is used as a drive element that causes ink to be discharged from a nozzle. However, the drive element that causes ink to be discharged from a nozzle is not limited to the piezoelectric element 47, but may be another piezoelectric element or a heater.

What is claimed is:

1. A liquid discharge head comprising:

a drive substrate including a plurality of drive elements and a plurality of electrodes respectively connected to the plurality of drive elements;

a flexible wiring substrate mounted in a standing state with respect to the drive substrate; and a semiconductor device which is mounted on the flexible wiring substrate and which has a pair of long sides in a direction crossing a direction in which the flexible wiring substrate stands, wherein a plurality of output electrodes respectively electrically connected to the electrodes of the drive substrate are arranged on and along the long side of the semiconductor device facing the drive substrate, a plurality of input electrodes are arranged on and along the long side opposite to the long side of the semiconductor device facing the drive substrate, and a circuit that drives the drive element is provided in a region between two certain input electrodes of the semiconductor device.

2. The liquid discharge head according to claim 1, wherein all the output electrodes of the semiconductor device which are electrically connected to the electrodes of the drive substrate are arranged on the long side facing the drive substrate.

3. A liquid discharge device comprising:

a drive substrate including a plurality of drive elements and a plurality of electrodes respectively connected to the plurality of drive elements;

a flexible wiring substrate mounted in a standing state with respect to the drive substrate; and a semiconductor device which is mounted on the flexible wiring substrate and which has a pair of long sides in a direction crossing a direction in which the flexible wiring substrate stands, wherein a plurality of output electrodes respectively electrically connected to the electrodes of the drive substrate are arranged on and along the long side of the semiconductor device facing the drive substrate, a plurality of input electrodes are arranged on and along the long side opposite to the long side of the semiconductor device facing the drive substrate, and a circuit that drives the drive element is provided in a region between two certain input electrodes of the semiconductor device.

* * * * *